US007857299B2

(12) United States Patent
Möckli

(10) Patent No.: US 7,857,299 B2
(45) Date of Patent: Dec. 28, 2010

(54) METHOD AND DEVICE FOR ADDING ONE INSERT EACH TO FOLDED OR BOUND PRINTED PRODUCTS

(75) Inventor: Heinz Möckli, Grut (CH)

(73) Assignee: FERAG AG, Hinwil (CH)

( * ) Notice: Subject to any disclaimer, the term of this patent is extended or adjusted under 35 U.S.C. 154(b) by 199 days.

(21) Appl. No.: 12/297,688

(22) PCT Filed: Oct. 4, 2006

(86) PCT No.: PCT/CH2006/000543

§ 371 (c)(1),
(2), (4) Date: Dec. 12, 2008

(87) PCT Pub. No.: WO2007/118339

PCT Pub. Date: Oct. 25, 2007

(65) Prior Publication Data

US 2009/0102116 A1 Apr. 23, 2009

(30) Foreign Application Priority Data

Apr. 19, 2006 (CH) ..... 0639/06

(51) Int. Cl.
*B65H 29/04* (2006.01)

(52) U.S. Cl. ..... 270/52.19; 270/52.18; 271/69; 271/205

(58) Field of Classification Search ..... 270/52.14, 270/52.18, 52.19, 52.23, 52.24, 52.25, 52.26, 270/52.27, 52.28, 52.29; 198/644; 271/69, 271/204, 205

See application file for complete search history.

(56) References Cited

U.S. PATENT DOCUMENTS 5,007,624 A * 4/1991 Chandhoke ..... 270/58.2
5,137,409 A * 8/1992 Honegger ..... 412/8
5,188,349 A * 2/1993 Honegger ..... 270/52.22
5,551,682 A 9/1996 Luthi
5,662,319 A 9/1997 Honegger (Continued)

FOREIGN PATENT DOCUMENTS

EP 0 659 586 A1 6/1995

(Continued)

*Primary Examiner*—Patrick Mackey
(74) *Attorney, Agent, or Firm*—Rankin, Hill & Clark LLP

(57) ABSTRACT

Folded inserts (B) are added to folded or bound printed products (P) which, held individually by transfer grippers (6), are conveyed in an essentially continuous fashion, in that the inserts are placed on the folded or rear edges of the printed products in a manner whereby their fold (8) is aligned with the folded or rear edge of the latter. If necessary, the inserts (B) are attached by gluing or stapling to the folded or rear edges of the printed products (P). For adding small inserts the printed products (P) can be conveyed with their folded or rear edges held by the transfer grippers (6) of a printed product conveyor (1) and the insert (B) can be placed next to the gripper (6). If the inserts are larger (B), an auxiliary conveyor takes over the printed products for the placement of the inserts. Such placement of inserts (B) into printed products (P) is simple and can, in particular, be implemented with conventional device components and easily integrated into existing equipment.

24 Claims, 8 Drawing Sheets

U.S. PATENT DOCUMENTS

| | | | | |
|---|---|---|---|---|
| 6,612,559 | B2 * | 9/2003 | Boss | 270/52.18 |
| 6,698,742 | B2 * | 3/2004 | Hansch | 270/52.22 |
| 6,708,968 | B2 | 3/2004 | Honegger | |
| 7,318,587 | B2 | 1/2008 | Hansch | |
| 7,384,030 | B2 * | 6/2008 | Nagai | 270/52.18 |
| 2005/0061420 | A1 | 3/2005 | Hansch | |
| 2006/0231998 | A1 * | 10/2006 | Maeder | 270/52.14 |

FOREIGN PATENT DOCUMENTS

| | | | |
|---|---|---|---|
| EP | 1 254 857 | A2 | 11/2002 |
| EP | 1 516 839 | A1 | 3/2005 |
| EP | 1 547 950 | A1 | 6/2005 |

* cited by examiner

Fig.4
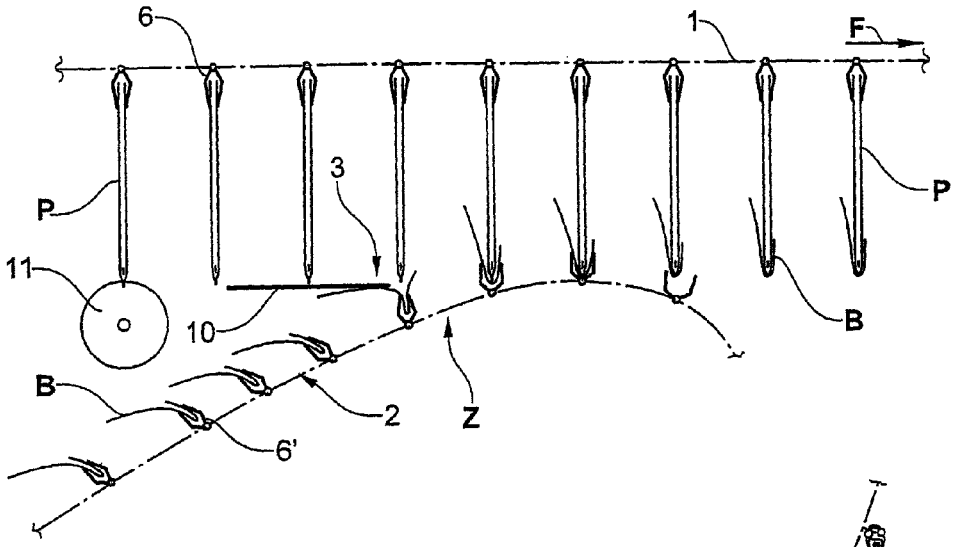
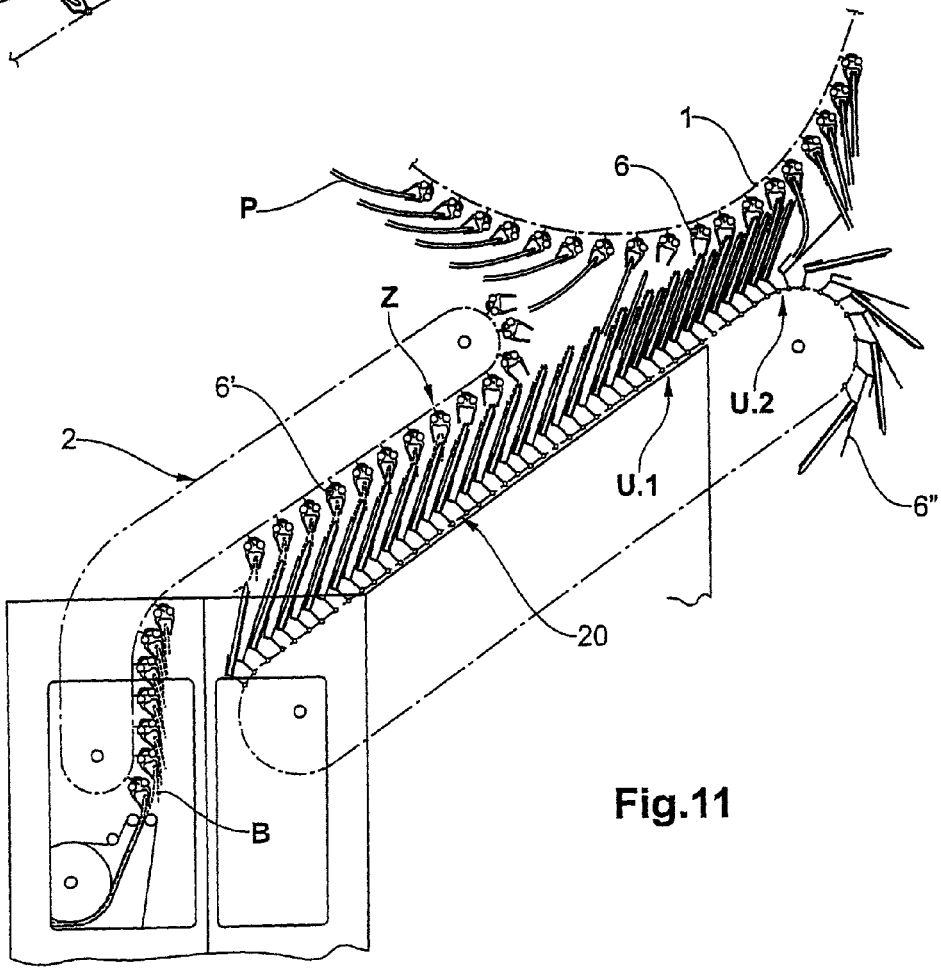
Fig.11

METHOD AND DEVICE FOR ADDING ONE INSERT EACH TO FOLDED OR BOUND PRINTED PRODUCTS

BACKGROUND OF THE INVENTION

1. Field of the Invention

The invention lies in the field of further processing of printed products and relates to a method and to a device according to the preambles of the respective independent patent claims. The method and device according to the invention serve for adding, in each case, a supplement to folded or bound printed products, which thus have a fold edge or back edge which is characterised by a last fold or a bound back, during an essentially continuous conveying, with which the printed products in each case are conveyed in a held manner in a compact conveyor flow. The printed products are for example newspapers, magazines or brochures.

2. Description of Related Art

According to known methods, supplements are added during a continuous conveying to folded or bound printed products, for example by way of each printed product being opened and the supplement being inserted into the printed product, by way of the printed product being manufactured by way of collection or insertion and the supplement being glued onto the last added sheet before the addition of a further sheet, by way of the printed product being opened and the supplement glued in, or by way of the supplement being applied onto the finished printed product and being packaged together with this, for example with the help of a transparent foil.

It is the object of the invention to provide a further method for adding supplements to individual, essentially continuously conveyed folded or bound printed products. The method and the device according to the invention should be simple, take up little space and be able to be realised where possible with known device parts, so that existing conveyor systems may also be extended in a simple manner for the method.

BRIEF SUMMARY OF THE INVENTION

The supplement which, according to the method according to the invention, is added to each individual one of the folded or bound printed products, is a folded supplement and according to the method according to the invention, in the folded condition in which the supplement parts separated by the fold at least partly lie on one another, is fed, is opened directly before the addition and is deposited on the outside on the fold edge of the back edge of the printed product, in a manner such that the two supplement parts lie on the front side and/or the rear side or on the fold edge or back edge of the printed product, and the fold of the supplement is aligned to the fold edge or back edge of the printed product. For the addition of the supplement, the printed products are conveyed in a conveyor flow, one after the other, with surfaces aligned essentially transversely or obliquely to the conveyor direction, and held individually by way of grippers which engage on the fold edge or back edge, on the edge lying opposite the fold edge or back edge, or on both side edges (edges which connect to the fold edge or back edge), through an addition region, wherein an addition location is provided within the addition region, at which addition location the supplements are deposited on the printed products. Moreover, the addition region upstream and/or downstream of the addition location, as the case may be, has regions in which the conveying of the printed products is changed, wherein one of the above method conveyor types is set upstream of the addition location for the addition of the supplements, or the mentioned conveyor type is again relieved by a different conveyor type downstream of the addition location. The supplements are supplied individually to the addition location in the folded condition and likewise in a held manner, are opened directly in front of the addition location and are deposited onto the fold edges or back edges of the printed products at the addition location.

With a suitable format of the supplement, these may be deposited next to a gripper conveying the printed product in a held manner on the fold edge or back edge, so that the gripper may convey the printed product not only into the addition region, but also through this and away from this. If the supplement is too large, in order to be deposited next to a gripper holding the printed product on the fold edge or back edge, the printed products, although likewise being conveyed held at the folded edges and back edges to the addition region and away from this, for conveying through the addition region, they must however be taken over by an auxiliary conveyor which is designed in order to convey the printed products through the addition location held at least at a different edge than the fold edge or back edge. In such a case however, it is also possible to convey the printed product held at a different edge than the fold edge or back edge, to the addition region, through the addition region and away from the addition region.

In the method according to the invention therefore, the folded supplement is opened and is deposited on the fold edge or back edge of the printed product, which is a similar procedure as the deposition of an individual sheet in a known collection process, in which printed products of individual, folded sheets are manufactured by way of firstly opening the innermost sheet and depositing it on a saddle-like rest and then opening the further sheets and depositing them in the same manner one after the other, up to the outermost sheet. However, with the method according to the invention, in contrast to the known collection, one does not use a saddle-like rest, but the printed product itself represents the rest on which the supplement is deposited. Against expectations, it has been found that no great demands whatsoever need to be placed on the stability of the printed product and in particular on the stability of the fold edge or back edge of the printed product, for a successful implementation of the method according to the invention.

For fastening the supplement on the printed product, one may deposit an adhesive on the fold edge or back edge of the printed product, on the front side or rear side of the printed product in the region of the fold edge or back edge, before depositing the supplement on the printed product, or if the printed product is folded, the supplement may be stitched together with the printed product in the region of the fold edge. The combination of a folded or bound printed product and supplement manufactured according to the inventive method may, however, also be packaged, for example, in a transparent foil for the fixation. A fastening of the supplement on the printed product may also be completely done away with, depending on the further processing or further use of the combination of the printed product and supplement.

The supplements are, for example, fed one after the other clamped between two conveyor belts and with trailing fold edges, or as with the printed products in a conveyor flow, in which the fold edges of the supplements are aligned essentially transversely to the conveyor direction and each supplement is held individually at the fold edge. The supplements are opened in the way and manner known per se directly before the deposition on the fold edges or back edges of the printed products. For the opening of the supplements without any problem, it is advantageous if these are not folded in the middle, thus have a prefolding.

The supplements are preferably sheets folded once, which are significantly smaller than the printed products. The supplements may however also be sheets which are folded several times, or be multi-sided, for example stitched booklets. The method according to the invention itself places no constraints on the format of the supplements.

The method according to the invention is, in particular, suitable for the addition of advertising supplements to newspapers, magazines or brochures, wherein the supplements which are added according to the method according to the invention, have a very prominent position and, when they are stitched or glued to the printed product, may not be eliminated as easily as inserted supplements.

The supplements may have potential fold lines additionally to the fold, which means grooved, perforated or differently weakened lines, which run parallel to the fold and distanced to this, and along which the supplements are at least creased on depositing onto the fold edge or back edge of the printed product. By way of this, the supplement obtains a wider back, so that it may be deposited on a correspondingly wide back edge of a bound printed product or on the fold edge of a correspondingly thicker, folded printed product, without any problem. If the potential fold line is a perforation line, it may additionally serve for rendering the one supplement part separable from the other supplement part in a simple manner and in a manner such that the reader may simply separate away this part also in an easy manner, when the supplement is fastened on the printed product by way of adhesive or stitching.

The device, according to the invention, which is suitable for carrying out the method according to the invention, includes conveyor means for the essentially continuous conveying of a compact conveyor flow of the printed products to the addition region, through the addition region and away from the addition region, wherein the folded edges or back edges of the printed products in this compact conveyor flow are aligned transversely or obliquely (not parallel) to the conveyor direction, and wherein the arrangement of the printed products in the conveyor flow essentially does not change in the mentioned conveying. All mentioned conveyor means comprise a plurality of grippers or gripper pairs, wherein each gripper or each griper pair is designed for the gripping and the held conveying in each case of a printed product. The conveying means are, for example, revolving gripper transporters which on a link chain comprise grippers arranged at regular distances to one another. The conveyor means may, however, also comprise conveyor elements which are essentially independent of one another, which in each case carry a gripper and which may be conveyed one after the other and with varying distances to one another along a rail.

As will yet be shown, three separate conveyors may be provided for conveying the printed products to the addition region, through the addition region, and away from the addition region, or the same conveyor may be applied for conveying to and away from the addition region and an auxiliary conveyor for conveying through the addition region. It is also possible to apply a single conveyor. The device according to the invention, additionally to the conveyor means for conveying the printed products, includes a feed means for the supplements and a means for opening the supplements, wherein the feed means is designed for the held feeding of the folded supplements. It is also possible to apply the printed product conveyor also for the feeding of the supplements.

As the case may be, the device according to the invention, for fastening the supplements on the printed products, includes a means upstream of the addition location for depositing an adhesive, and a means for pressing on the supplement, downstream of the addition location. On the other hand one may also provide a stitching device for the mentioned fastening, which is to be arranged downstream of the addition location.

BRIEF DESCRIPTION OF THE DRAWINGS

Advantageous embodiments of the method and the device according to the invention are described in detail by way of the following figures. Thereby, there are shown in:

FIG. 4 a further exemplary embodiment of the method and the device according to the invention, wherein the printed products held on an edge which is not the fold edge or back edge, are conveyed into the addition region, through the addition region and away from the addition region;

FIG. 11 a further exemplary embodiment of the method and device according to the invention, wherein the printed products held on the fold edge or back edge, are conveyed to the addition region and away from this, and for conveying through the addition region, are taken over by an auxiliary conveyor which holds the printed products at the edge lying opposite the fold edge or back edge;

DETAILED DESCRIPTION OF THE INVENTION

The devices represented in the figures are all shown very schematically and only partly. Since ails elements known per se may be used for all device parts, the schematic figures despite this permit the man skilled in the art to realise the shown devices without further ado. It is also simply possible for the man skilled in the art to combine the features of the method and the device shown in the individual figures in a different manner, by which means further embodiments of the invention arise, which are not illustrated, but however belong to the invention.

FIGS. 1, 2, 3A and 3B show a first, exemplary embodiment of the method and device according to the invention. According to this embodiment, the printed products are held by grippers at their fold edges or back edges, and are conveyed in an essentially freely hanging manner in a conveyor flow in a conveyor direction F to the addition region, through the addition region and away from the addition region, for which advantageously a single conveyor is employed. This means that the gripper holding the printed product covers a region of the fold edge or back edge, so that no supplement may be deposited on this region. By way of this, the format of the supplement is limited inasmuch as the fold edge of the supplement may not be significantly longer that the part of the fold edge or back edge of the printed product, which is not covered by the gripper.

Figure 1:
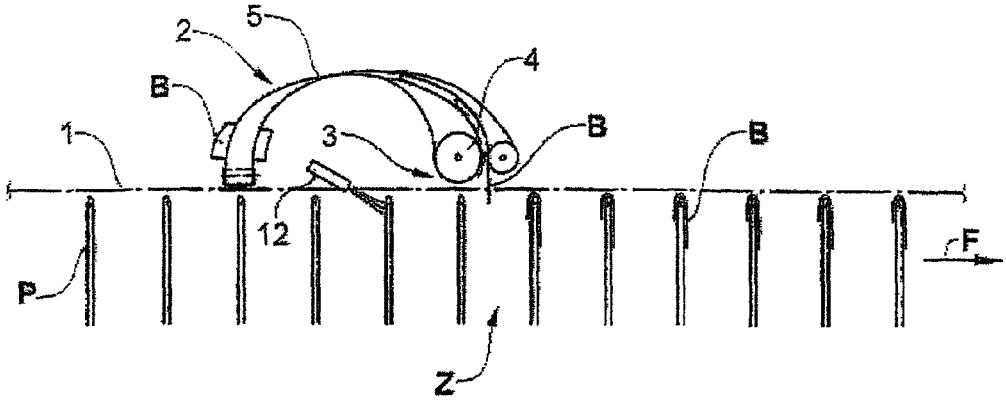
FIGS. 1, 2, 3A, 3B a first, exemplary embodiment of the method and the device according to the invention, wherein the printed products held at the fold edges or back edges, are conveyed to the addition region, through the addition region and away from the addition region.
Figure 2:
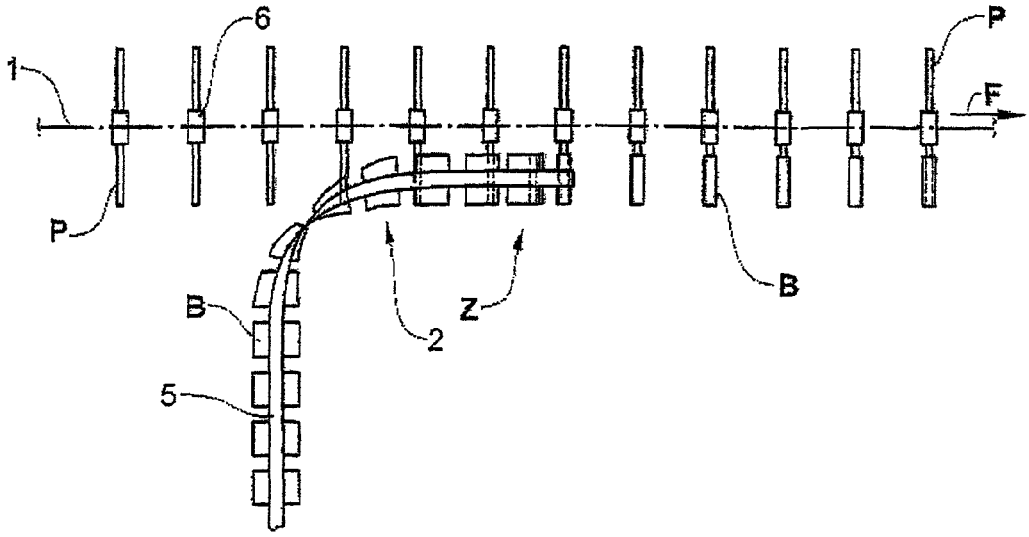
Figure 3A:
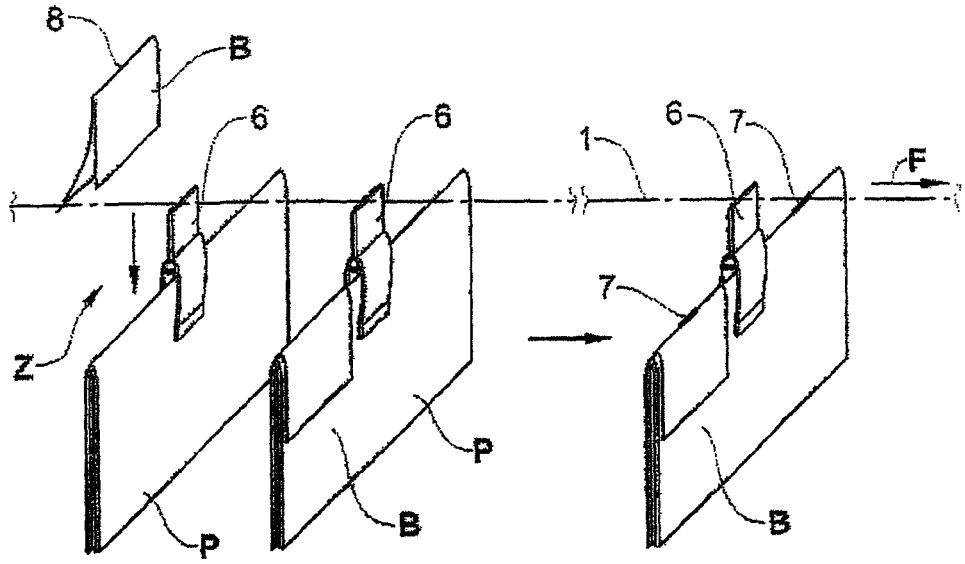
Figure 3B:
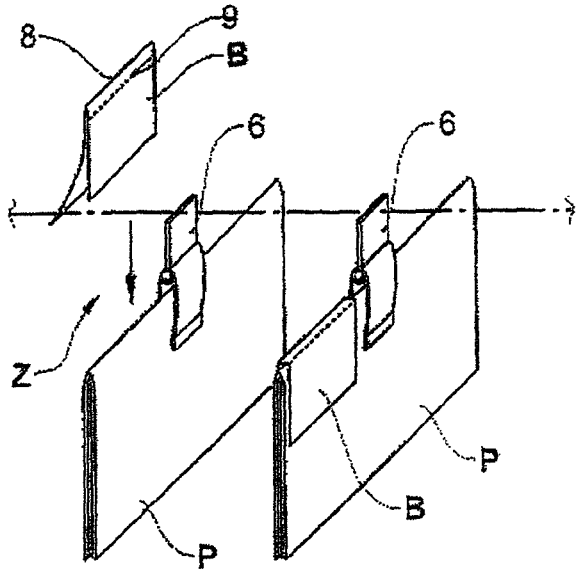

FIG. 1 in a very schematic manner shows a device for carrying out the mentioned method, seen from the side, and FIG. 2 from above. FIGS. 3A and 3B show two variants of the method by way of the printed products and the supplements.

The device, as a conveyor for the printed products P (printed product conveyor 1 indicated by way of dot-dashed lines), comprises a gripper transporter with grippers 6. Moreover, the device comprises feed means 2 and an opening means 3, for feeding and opening the supplements B. The feed means 2, in the shown case, is designed as a conveyor belt pair 5 (two conveyor belts which are pressed against one another and revolve in opposite directions), wherein the supplements B in the folded condition and with trailing fold edges are conveyed behind one another clamped between the two conveyor belts, towards the opening means 3, and wherein the conveyor belt pair 5 has a winding or a loop for a direction change. The supplements B are for example singularised from a feeder (not represented) in which they are stacked in an already folded manner, and positioned at the entry of the feed means 2. The opening means 3 which is arranged at the addition location Z directly above the conveyor flow of printed products P, is combined in a known manner with at least one of the deflection rollers 4 of the conveyor belt at the exit of the feed means 2, wherein this defection roller 4 is equipped with holding means (not represented), which grip the leading edge of the one part of the folded supplements B and lead it around the periphery of the deflection roller and thus separate it from the other part, and open the supplement B.

An exemplary type of fastening of the supplement B on the printed product P is indicated in FIG. 1. This lies in depositing an adhesive, for example by way of a spray head 12, on the front side or the rear side of the printed product P, advantageously in the region of the fold edge or back edge, before reaching the addition location. For pressing the supplements on these adhesive locations, the printed products P with the supplements B deposited thereon, may be conveyed for example as an imbricate flow, between two conveyor belts pressed against one another, downstream of the addition location (not shown).

FIG. 3A shows the printed products P which are conveyed held by the grippers 6 of the printed product conveyor 1 at their fold edge or back edges, from the left to the right, and a further type of fastening of the added supplements on the printed products. The printed products are represented: in the addition location Z, where the supplement B is deposited in the opened condition from above next to the gripper 6 on the fold edge or the back edge of the printed product P; downstream of the addition location Z, where the supplement B lies on the fold edge or back edge of the printed product P, and after passing a stitching device of the known type which is not shown, where the supplement B is fastened on the printed product P by way of staples 7 and where, as the case may be, the individual sheets of a multi-sided, folded printed product are also simultaneously connected to one another.

The supplement B shown in FIG. 3A, is folded along a fold 8, wherein the two supplement parts separated by the fold 8, after depositing the supplement on the printed product P, lie at least partly on the front side or rear side of the printed product, and wherein the fold 8 of the supplement is aligned to the fold edge or back edge of the printed product P. The fold 8 of the supplement B, given a thin printed product, would essentially lie on the fold edge or back edge of the printed product, and given a thicker product, would have a distance to this.

In the same manner as FIG. 3A, FIG. 3B shows the addition location Z, in which the supplement B is deposited on the fold edge or the back edge of the printed product P in the opened condition, and downstream of the addition location Z in the deposited condition. In contrast to the method according to FIG. 3A, the supplement B here, additionally to the fold 8, comprises one (or more than one) potential fold line 9 which is parallel to the fold 8 and is distanced to this and which is designed as a grooved, scored or perforated line, in a manner such that the supplement may be folded or creased in an accurate manner along this potential fold line in a simple manner, which means essentially without doing anything. If then the supplement B is deposited onto a thicker printed product and advantageously is yet slightly pressed on the fold edge or back edge of the printed product at a later stage, then the fold 8 will position itself on the one side of the fold edge or back edge, and the potential fold line 9 on the other side of the fold edge or back edge, and the thus produced, wider "back" of the supplement B will bear more tightly onto the fold edge or back edge of a correspondingly wide printed product. This may be the case with the supplement B as is shown in FIG. 3A. This is particularly advantageous if the supplement B is to be fastened on the fold edge or back edge of the printed product by way of an adhesive.

Of course, it is also possible to design the supplement with more than one potential fold line 9, wherein these fold lines then advantageously are arranged on both sides of the fold 8 and relatively close to one another. Such a design of the supplement permits the supplement to be bent in the manner of a polygon, by which means it may snuggle, in particular, onto the fold edge of a thicker, folded printed product and may, as the case may be, be fasted on this in a simpler manner.

FIG. 4 shows (in the same schematic manner and seen from the side as FIG. 1) a further embodiment of the method and device according to the invention. A main feature of the embodiment according to FIG. 4 lies in the printed products P being conveyed to the addition region, through the addition region and away from this, not being held at the fold edges or back edges, but at the edges lying opposite these, wherein the fold edges or back edges of the printed products P are directed downwards. With this method, it is possible to convey the printed products with the same printed product conveyor 1 (e.g. gripper transporter) to the addition region, through the addition region and away from this, wherein despite this, the fold edge or back edge of the printed products remains free for the deposition of the supplement, and the fold of the supplements B may be essentially equally as long as the fold edge or back edge of the printed products P by way of this. The supplements B, however, must be fastened on the printed products P, for example by way of adhesive, essentially simultaneously with the deposition on the printed product.

The supplements B are fed from below by way of the supplement feed means 2 designed as a further gripper transporter. The opening means 3 is designed as a bending cam 10 which extends in the conveyor direction F towards the addition location Z and ends at this. The bending cam 10 is arranged in a manner such that the supplements B which are held to the top by the grippers 6' of the supplement feed means 2, are bent to the rear on the bending cam 10 and that the leading, shorter part of an supplement which is not folded in the middle and which is firstly released from the bending cam 10, moves away from the longer part which is still bent downwards by the bending cam, by which means the supplement is opened and is held in an open position, at least until the longer supplement part is also released by the bending cam 10.

FIG. 4 also show a means 11 for depositing an adhesive onto the fold edges or bend edges of the printed products P directly in front of the addition location Z. Means for depositing an adhesive which are suitable for the application are known to the man skilled in the art. The bending cam 10 thereby also serves for the prevention of an uncontrolled transfer of adhesive from the fold edges or back edges of the printed products P onto the supplements B.

Figure 5:
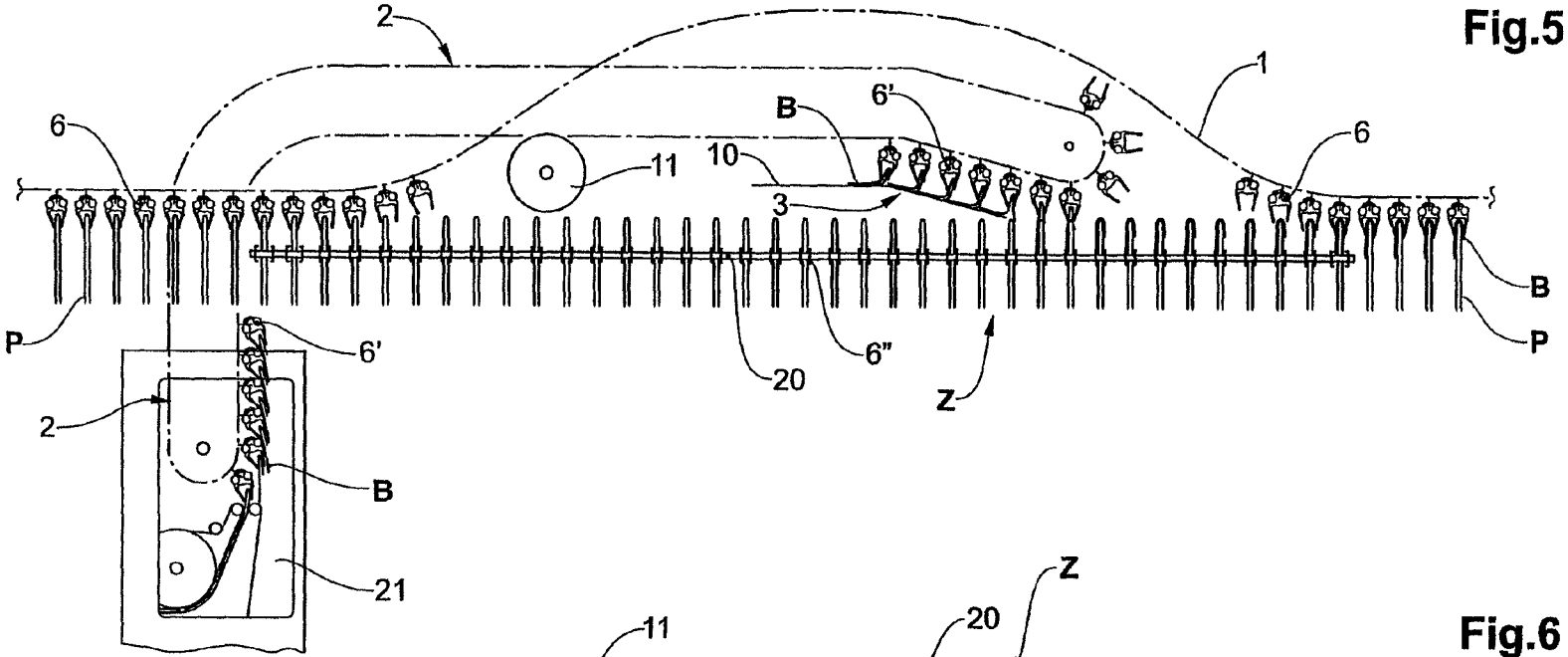
FIGS. 5 to 7 a further exemplary embodiment of the method and the device according to the invention, wherein the printed products held at the fold edge or the back edge, are conveyed to the addition region and away from this, and for conveying through the addition region, are taken over by an auxiliary conveyor which laterally holds the printed products.
Figure 6:
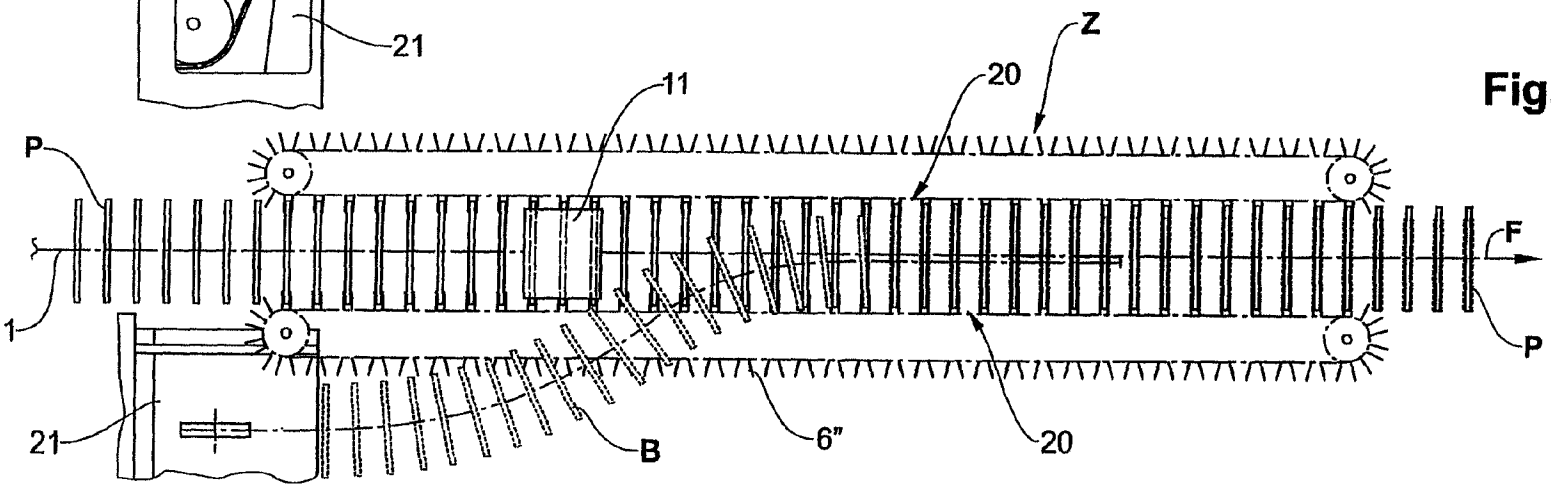
Figure 7:
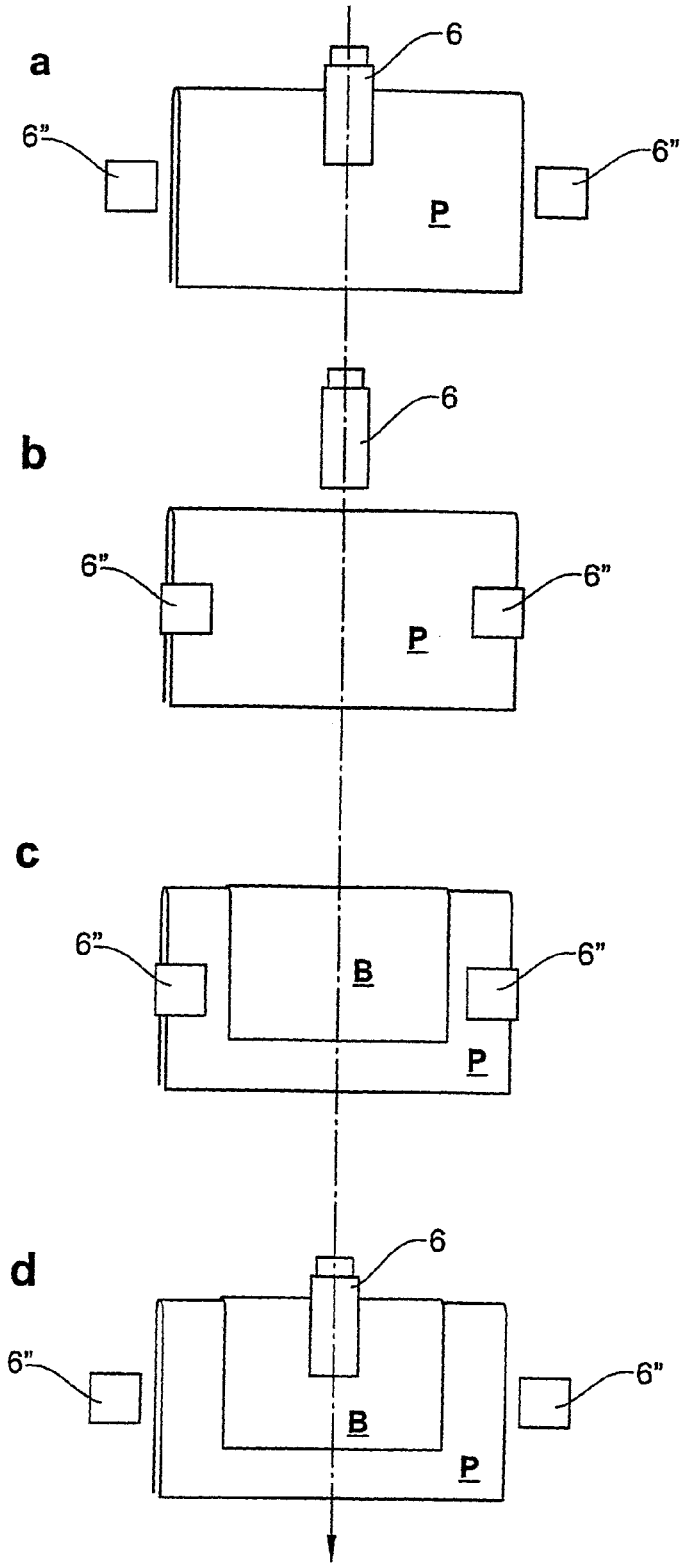

FIGS. 5 to 7 illustrate a further exemplary embodiment of the method and the device according to the invention. FIG. 5 shows the device from the side, FIG. 6 from above and FIG. 7 shows consecutive phases a to d of the printed product and the supplement. The main features of the embodiment of the method and the device according to the invention which are shown in the FIGS. 5 to 7, are the conveying of the printed products P to the addition region and away from this by way of the printed product conveyor 1 (e.g. gripper transporter) with grippers 6, which hold the printed products P at their fold edges or back edges, the transfer of the printed products P to an auxiliary conveyor 20 for conveying through the addition location, wherein the auxiliary conveyor 20 holds the printed products P at both edges which border the fold edge or back edge, the re-takeover of the printed products P (with the supplements B) downstream of the addition location Z by way of the printed product conveyor 1, and the distancing between the printed products P and the grippers 6 of the printed product conveyor 1 in the addition location Z, which in the represented case is limited by a bending of the conveyor path of the printed product conveyor 1 to the top.

The auxiliary conveyor 20 comprises two gripper transporters revolving in opposite directions, with grippers 6", wherein a gripper transporter is arranged on each side of the conveyor flow of the printed products P. The printed product conveyor 1 and the auxiliary conveyor 20 are arranged and are synchronously operated, in a manner such that the grippers 6" of the auxiliary conveyor 20 have gripped a printed product before the respective gripper 6 of the printed product conveyor 1 lets go of the printed product and has moved away from this to the top, and that a gripper 6 of the printed product conveyor 1 has gripped the printed product P with the supplement B, before the grippers 6" of the auxiliary conveyor 20 release the printed product and move away from this.

The supplement feed means 2 is likewise designed as a gripper transporter with grippers 6', wherein the supplement feed means 2 grips the supplements B, for example, from the feeder 21, and held individually at the fold edges, conveys them from the side above the compact printed product flow and then towards this from above. The supplements B again are opened directly above the printed product flow by way of bending cams 10, and then deposited onto the printed products P (addition location Z).

A means 11 for applying an adhesive onto the fold edges or back edges of the printed products P is also shown in FIGS. 5 and 6. In this case too, the bending cam 10 not only serves for opening the supplements B, but also for preventing an uncontrolled transfer of the adhesive from the fold edge or back edges of the printed products P onto the supplements B.

FIG. 7 shows consecutive phases a to d of the method: in phase a, the printed product P, held by the gripper 6 of the printed product conveyor on the fold edge or back edge, is conveyed towards the addition location, whilst the grippers 6" of the auxiliary conveyor approach from the side. In phase b, the printed product P is located directly in front of the addition of the supplement (not shown); it is held by the gripper 6" of the auxiliary conveyor, whilst the gripper 6 of the printed product conveyor moves away to the top. In phase c, the printed product P is located directly after the addition location; the supplement B is deposited and the printed product P is still held by the grippers 6" of the auxiliary conveyor. In phase d, the combination of the printed product and supplement is located downstream of the printed product conveyor and is held by the gripper 6 of the printed product conveyor, whilst the grippers 6" of the auxiliary conveyor move away laterally from the printed product.

The advantages of the embodiment of the method and device according to the invention which are illustrated in the FIGS. 5 to 7 are to be seen in the fact that the format of the supplement is not limited by the grippers 6 of the printed product conveyor 1, and that the combination of printed product and supplement may be conveyed further in a secure manner also without any fastening of the supplement on the fold edge or back edge of the printed product.

It is also conceivable to use a first printed product conveyor for the conveying of the printed products P to the addition region, and to use a second printed product conveyor for the conveying away from the addition region, wherein the two printed product conveyors are independent of one another.

Figure 8:
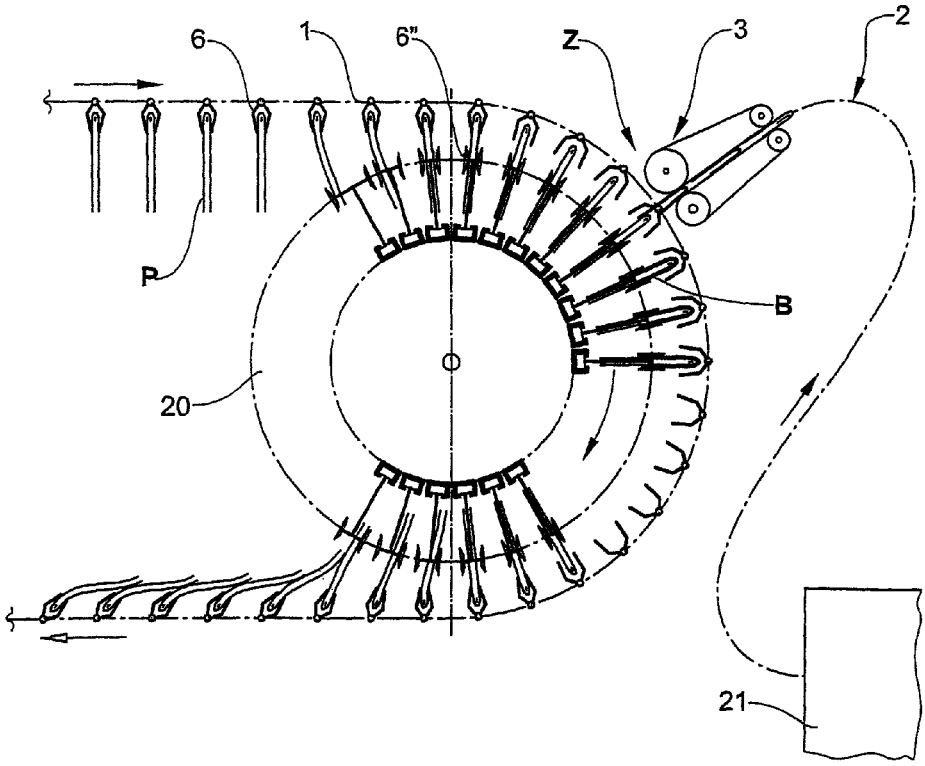
FIGS. 8 to 10 a further exemplary embodiment of the method and the device according to the invention, wherein the printed products held on the fold edge or back edge, are conveyed to the addition region and away from this, and for conveying through the addition region are taken over by an auxiliary conveyor which laterally holds the printed products.
Figure 9:
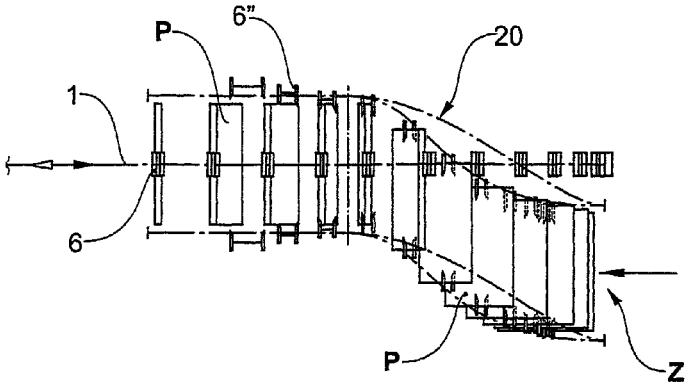
Figure 10:
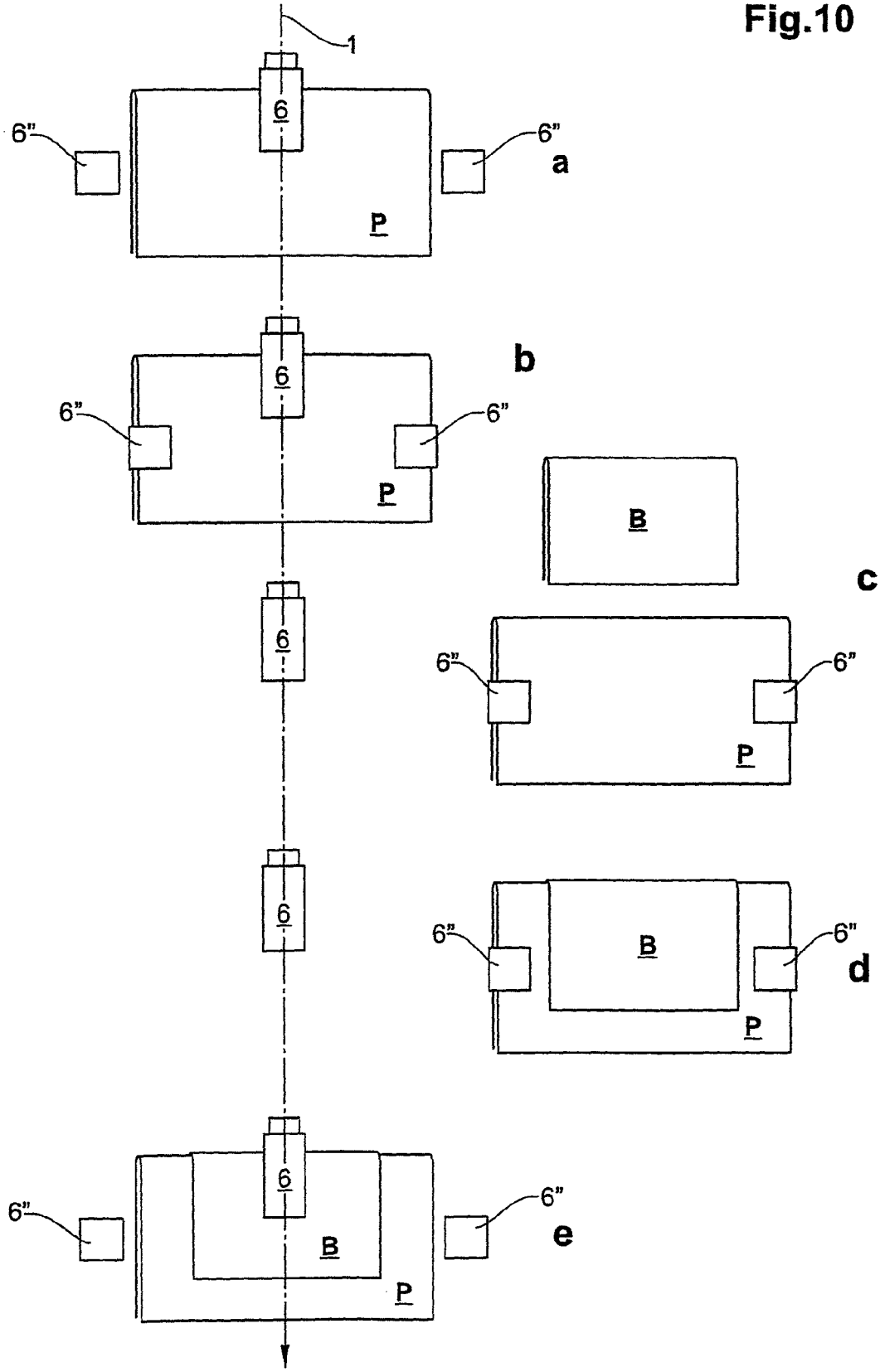

FIGS. 8 to 10 illustrate a further exemplary embodiment of the method and device according to the invention (FIG. 8: lateral view; FIG. 9: view from above; FIG. 10: method phases a to e). The principle of this embodiment is the same as the principle of the embodiment according to FIGS. 5 to 7, which means the printed product conveyor 1 conveys the printed products P held at their fold edges or back edges to the addition region and away from this. For conveying through the addition location, the printed products P are taken over by an auxiliary conveyor 20, whose grippers 6" hold the printed products P on edges which border the fold edge or back edge on both sides.

The grippers 6" of the auxiliary conveyor 20 run essentially on a vertical circular path and are displaced in a region in front of the addition location Z in the axial diction and in a region after the addition location are displaced back in the opposite direction. The conveyor path of the printed product conveyor 1 in the addition region likewise runs downwards in the manner of a circular arc about the middle point of the circular path of the grippers 6" of the auxiliary conveyor 20, wherein the vertical distance between the two conveyors 1 and 20 remains equal and wherein the printed products P are brought from an essentially vertical position with upwardly directed fold edges or back edges, into a horizontal position, and then into a vertical position with downwardly directed fold edges or back edges. The printed products P depart from the grippers 6 of the printed product conveyor 1 by way of the axial displacement of the grippers 6" of the auxiliary conveyor 20, so that their fold edges or back edges become free for the deposition of the supplements B.

FIG. 10 shows consecutive phases of the method: In phase a, the printed product P is located in front of the addition location; it is held by the gripper 6 of the printed product conveyor, and the grippers 6" of the auxiliary conveyor approach from the side. In phase b, the printed product is held by the gripper 6 of the printed product conveyor, as well as by the grippers 6" of the auxiliary conveyor. In phase c, the grippers 6" of the auxiliary conveyor are laterally displaced and the supplement B is deposited, wherein the fold edges or back edges of the printed product are advantageously still directed upwards (see position of the addition location Z in FIG. 8). The supplement is deposited in phase d. In phase e, the grippers 6" of the auxiliary conveyor are displaced back again into the region of the gripper 6 of the printed product conveyor; the gripper 6 of the printed product conveyor has gripped the combination of the printed product and the supplement, and the grippers 6" of the auxiliary conveyor depart laterally.

FIG. 11 in a schematic lateral view shows a further embodiment of the method and the device according to the invention. In this embodiment too, the printed products are taken over by an auxiliary conveyor 20 for the conveying through the addition location, wherein the grippers 6" of the auxiliary conveyor 20 engage on the edges of the printed products P which lie opposite the fold edges and back edges. One of the gripper parts is extended and is designed as a support for the printed product P, in order for the grippers 6" of the auxiliary conveyor 20 to securely hold and guide the printed products P in all positions, where possible. The grippers 6" run on a path which is closed per se and they run through a take-over location U.1, a transfer location U.2 and the addition location Z one after the other, wherein the conveyor frequency (number of grippers which run through a defined point of the conveyor path per time unit) of the grippers 6" of the auxiliary conveyor 20 is twice as large as the conveyor frequency of the grippers 6 of the printed product conveyor 1, and an odd number of grippers 6" revolves.

Each second gripper 6" takes over a printed product P from the printed product conveyor 1 at the take-over location U.1 and leads it past the transfer location U.2 and through the addition location Z, where a supplement is deposited thereon. Then the combination of the printed product and supplement is conveyed past the take-over location U.1 into the transfer location U.2, where it is taken over by a gripper of the printed product conveyor 1. Thus, all grippers 6" of the auxiliary conveyor 20 are occupied between the take-over location U.1 and the transfer location U.2, and only every second one is occupied on the remainder of the revolving path of the auxiliary conveyor 20.

The advantage of the embodiment according to FIG. 11 lies in the fact that the auxiliary conveyor 20, the supplement feed means 2, and the opening means 3 may be integrated into an addition device, wherein this addition device, for example combined with a feeder, for example may also be only temporarily installed at almost any location at which the printed products are led past individually and held at their fold edges or back edges. The most varied of the mentioned locations are available in a dispatch room installation. Thereby, the conveyor path which is necessary as an addition region, is extremely small.

Figure 12:
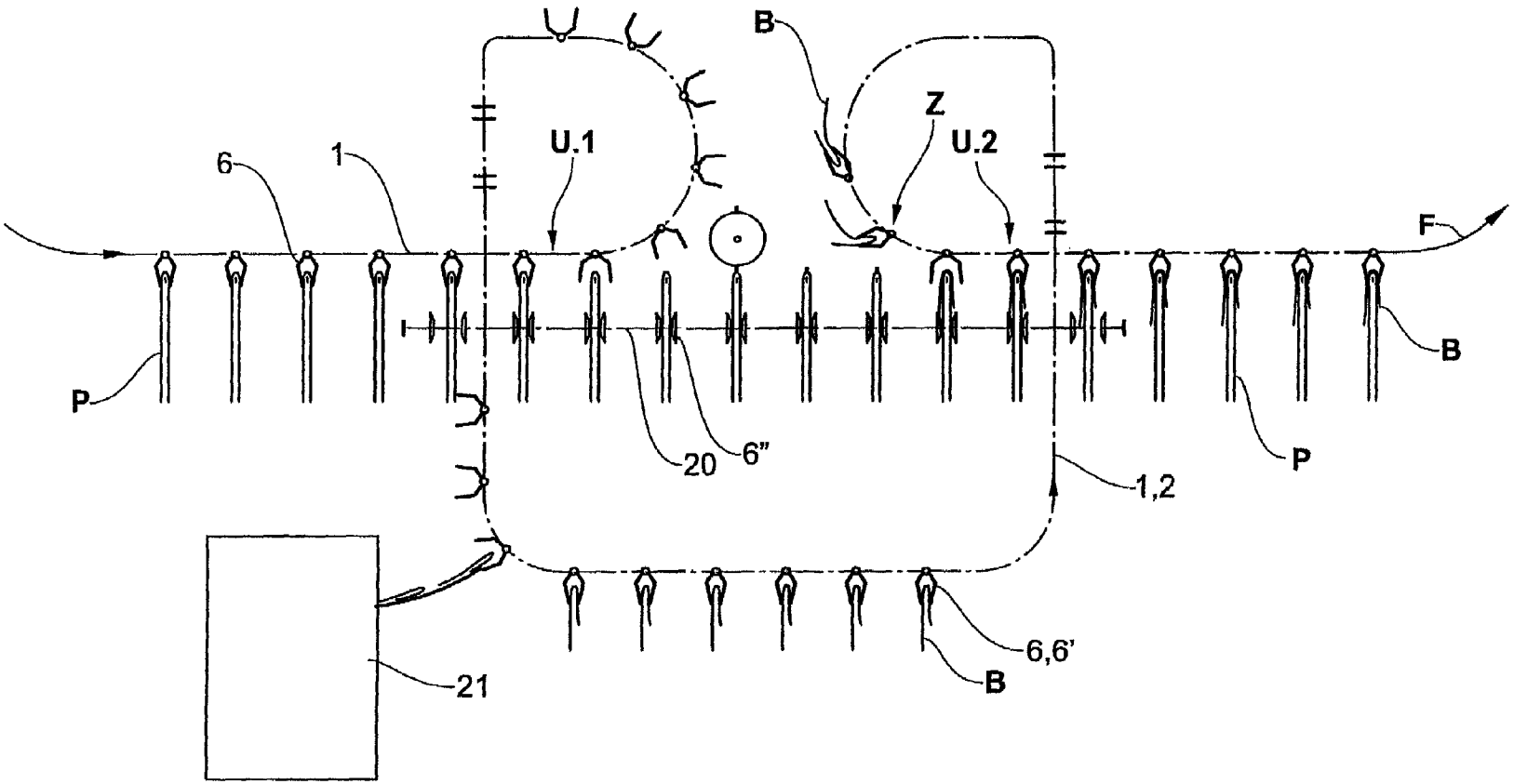
FIG. 12 a further exemplary embodiment of the method and the device according to the invention, wherein the printed products held on the fold edge or back edge, are conveyed to the addition region and away from this, and for conveying through the addition region are taken over by an auxiliary conveyor which laterally holds the printed products, and wherein the printed product conveyor also serves as a supplement feed means.

FIG. 12 as a last exemplary embodiment of the method and device according to the invention, again shows a very schematically represented device with a printed product conveyor 1 and auxiliary conveyor 20 (lateral view). According to this embodiment, the printed product conveyor 1 also assumes the function of the supplement feed means 2.

The printed product conveyor 1 is again a gripper transporter with grippers 6 which conveys the printed products P, held at their fold edges or back edges, to the addition region and away from the addition region. The printed products, for the conveying through the addition region are taken over by an auxiliary conveyor 20 with grippers 6" (take-over location U.1 and transfer location U.2). The auxiliary conveyor 20 is, for example, designed the same as the auxiliary conveyor of the embodiment according to FIGS. 5 and 6. Between the take-over location U.1 and the transfer location U.2, the conveyor path of the printed product conveyor 1, whose grippers 6 carry no printed products P in this region, runs laterally next to the auxiliary conveyor 20 and then past the printed product flow conveyed by the auxiliary conveyor 20, downwards to a location below the auxiliary conveyor 20, where supplements, for example, are fed from the feeder 21 to the grippers 6, and the supplements are taken over by the grippers 6. The conveyor path of the printed product conveyor 1 which in this region functions as a supplement feed means 2, then runs upwards again past the auxiliary conveyor 2 and from above to the addition location Z, at which the supplements are opened in the way and manner as has already been described, and deposited onto the fold edges or back edges of the printed product P which are held by the grippers 6" of the auxiliary conveyor 20. The grippers 6 may again take over the combination of the printed product P and the supplement B directly after this.

As is indicated in FIG. 12 by the different representation of the grippers 6, the conveyor path of the printed product conveyor 1 has windings, which means the function may then only be assumed by a conveyor means capable of winding.

In most figures of the present patent application, the printed products are conveyed through the addition region with their fold edges or back edges directed upwards, and the supplements are fed and deposited onto the fold edges or back edges of the printed products from above. This is not a condition for the method according to the invention. It is likewise possible to convey the printed products in a manner such that their fold edges or back edges are on the one side or at the bottom, and the supplements are to be fed and deposited from the side or below.

The invention claimed is:

1. A method for adding in each case a supplement to printed products which are conveyed in an essentially continuous manner in a conveyor flow, wherein the printed products are folded or bound and by way of this in each case comprise a fold edge or back edge, that the method comprising the steps of:

conveying the printed products in the conveyor flow in a conveyor direction through an addition location in an addition region, wherein fold edges or back edges of the printed products are aligned transversely or obliquely to the conveyor direction, and wherein the printed products are held by grippers individually at the fold edges or back edges, at the edges lying opposite the fold edges or back edges, or at both edges connecting to the fold edge or back edge, feeding the supplements folded along a fold, one after the other to the addition location Z, opening the supplements; and depositing an opened supplement on the fold edge or back edge of each printed product conveyed through the addition location, in a manner such that the fold of the supplement is aligned to the fold edge or back edge of the printed product.

2. A method according to claim 1, further comprising holding the printed products individually at their fold or back edges by grippers of a printed product conveyor conveying the printed products to the addition region, through the addition region and away from the addition region and depositing the supplements next to the grippers.

3. A method according to claim 1, further comprising holding the printed products (P) individually by grippers of a printed product conveyor at the edge lying opposite the fold edge or back edge, or on both edges connecting to the fold edge or back edge, and conveying the printed products to the addition region, through the addition region and away from the addition region.

4. A method according to claim 1, further comprising holding the printed products individually by grippers of a printed product conveyor at the fold edge or back edge, conveying the printed products to the addition region and away from the addition region, and holding the printed products for the conveying through the addition location by grippers of an auxiliary conveyor at the edge lying opposite the fold edge or back edge, or at both edges connecting to the fold edge or back edge.

5. A method according to claim 1, further comprising feeding the supplements to the addition location one after the other and with trailing folds.

6. A method according to claim 1, further comprising feeding the supplements to the addition location held individually in the region of the folds.

7. A method according to claim 1, wherein the supplements have a potential fold line parallel to the fold and distanced thereto, and further comprising the step of creasing along this potential fold line when depositing the supplements on the fold edges or back edges of the printed products.

8. A method according to claim 1, further comprising fastening the supplements the fold edges or back edges of the printed products.

9. A method according to claim 8, further comprising effecting the fastening by way of adhesive, wherein the adhesive is deposited upstream of the addition location on the front edge or back edge of the printed product in the region of the fold edge or back edge, or on the fold edge or back edge.

10. A method according to claim 8, further comprising effecting the fastening by way of stitching.

11. A method according to claim 1, wherein the supplements are not folded in the middle.

12. A device for adding a supplement to printed products with a fold edge or back edge, comprising:

conveyor means for the essentially continuous conveying of printed products in a conveyor flow with a predefined alignment of the fold edges or back edges, wherein the conveyor means are equipped with grippers for conveying the printed products in a conveyor flow and in a conveyor direction through an addition location in an addition region with fold edges or back edges aligned transversely or obliquely to the conveyor direction and individually held at their fold edges or back edges, at the edges which lie opposite the fold edges or back edges, or on both edges connecting to the fold edges or back edges, a supplement feed means designed for feeding the supplements folded along a fold to the addition location; and a supplement opening means designed for the opening of the fed supplements, wherein the supplement feed means and the supplement opening means are arranged and may be operated in a manner such that an opened supplement may be deposited in the addition location on the fold edge or back edge of each printed product conveyed through the addition location, wherein the folds are aligned to the fold edges or the back edges.

13. A device according to claim 12, wherein the conveyor means for conveying the printed products comprise a single printed product conveyor with grippers.

14. A device according to claim 13, wherein the printed product conveyor and the supplement feed means are arranged in a manner such that the printed products may be conveyed held by the grippers at their fold edges or back edges, and the supplements may be deposited next to the grippers.

15. A device according to claim 13, wherein the printed product conveyor and the supplement feed means are arranged in a manner such that the printed products may be conveyed held at the edges lying opposite the fold edges or back edges, or at both edges connecting to the fold edge or back edge, and the supplements may be deposited onto the fold edges or back edges of the printed products.

16. A device according to claim 12, wherein the conveyor means for conveying the printed products comprise a printed product conveyor with grippers and an auxiliary conveyor with further grippers, wherein the two conveyors are arranged in a manner such that the printed products may be conveyed by the printed product conveyor to the addition region and away from this, and that the printed products may be taken over by the auxiliary conveyor upstream of the addition location, and may be transferred again to the printed product conveyor downstream of the addition location.

17. A device according to claim 16, wherein the printed product conveyor and the auxiliary conveyor are arranged in a manner such that on account of the grippers of the printed product conveyor, the fold edges or back edges of the printed products, and on account of the further grippers of the auxiliary conveyor, the edge lying opposite the fold edge or back edge, or both edges connecting to the fold edge or back edges, may be gripped, and that the printed products may be distanced from the grippers of the printed product conveyor for conveying through the addition location.

18. A device according to claim 17, wherein the further grippers are designed for gripping the two edges which connect to the folded edges or back edges, and that for distancing the printed products from the grippers of the printed product conveyor, the printed product conveyor has a bending away from the auxiliary conveyor in the addition region.

19. A device according to claim 17, wherein the further grippers are designed for gripping the two edges connecting to the back edges or fold edges, and that for distancing the printed products from the grippers of the printed product conveyor, the printed product conveyor and the auxiliary conveyor are arranged at a constant distance from one another, and the further grippers of the auxiliary conveyor are displaceable transversely to the conveyor direction in the addition region.

20. A device according to claim 17, wherein the further grippers are designed for gripping the edges lying opposite the fold edges or back edges, and that the conveyor path of the auxiliary conveyor has a loop for the distancing of the printed products.

21. A device according to claim 12, wherein the supplement feed means comprises a pair of conveyor belts which may be pressed against one another.

22. A device according to claim 12, wherein the supplement feed means comprises grippers.

23. A device according to claim 22, wherein the function of the grippers of the supplement feed means is assumed by the grippers of the printed product conveyor.

24. A device according to claim 12, further comprising means for depositing an adhesive onto the printed products, which is arranged upstream of the feed location, or a stitching device, which is arranged downstream of the feed location for the fastening of the supplements on the printed products.

* * * * *